US006236553B1

(12) United States Patent
Widell

(10) Patent No.: US 6,236,553 B1
(45) Date of Patent: May 22, 2001

(54) SAFETY RELAY

(75) Inventor: Gunnar Widell, Malmö (SE)

(73) Assignee: Jokab Safety, Malmo (SE)

( * ) Notice: Subject to any disclaimer, the term of this patent is extended or adjusted under 35 U.S.C. 154(b) by 0 days.

(21) Appl. No.: 09/319,224

(22) PCT Filed: Nov. 28, 1997

(86) PCT No.: PCT/SE97/01995

§ 371 Date: Aug. 3, 1999

§ 102(e) Date: Aug. 3, 1999

(87) PCT Pub. No.: WO98/28764

PCT Pub. Date: Jul. 2, 1998

(30) Foreign Application Priority Data

Dec. 9, 1996 (SE) ..... 9604520

(51) Int. Cl.[7] ..... H01H 47/00
(52) U.S. Cl. ..... 361/189; 307/326
(58) Field of Search ..... 307/326, 328; 361/160, 189, 156; 192/129 A, 131 R

(56) References Cited

U.S. PATENT DOCUMENTS

| | | | | |
|---|---|---|---|---|
| 3,749,005 | * | 7/1973 | Einecker et al. | 192/131 R |
| 5,689,398 | * | 11/1997 | Miller et al. | 307/328 |
| 5,825,102 | * | 10/1998 | Babiel et al. | 307/326 |
| 5,912,795 | * | 6/1999 | Wetzel et al. | 361/189 |

FOREIGN PATENT DOCUMENTS

| | | |
|---|---|---|
| 0 380 089 A2 | 8/1990 | (EP) . |
| 2-61930 | 3/1990 | (JP) . |
| 465 067 | 7/1991 | (SE) . |

* cited by examiner

*Primary Examiner*—Fritz Fleming
(74) *Attorney, Agent, or Firm*—Burns, Doane, Swecker & Mathis, L.L.P.

(57) ABSTRACT

A safety relay for supervising and ensuring safe operation of a machine industrial process and corresponding safety devices and actuators. The safety relay has at least one input, which is monitored for short circuits and open circuits, for connection to said safety devices and actuators, at least one output for connection to said machine or process, one or more than one stop relay for maintaining and interrupting, respectively, the connection to said machine or process depending on a momentary status of said safety devices and actuators, and a reset circuit with at least one capacitor and a reset input. The capacitor receives and stores electrical energy in a first state, while discharging the electrical energy in a second state for resetting the safety relay to a normal state of operation. The safety relay also has first means connected to the capacitor, the first means establishing, in a first state, a closed current path between a first and second supply conductor for charging the capacitor, and, in the second state, the first means isolating the capacitor from the second supply conductor. Second means are arranged in parallel to the capacitor for conducting current, in the second state, from the capacitor via the second supply conductor to the relay coils in the stop relays for resetting the safety relay.

12 Claims, 4 Drawing Sheets

SAFETY RELAY

TECHNICAL FIELD

The present invention relates to a safety relay for supervising the operation and ensuring operational safety of a machine or an industrial process and corresponding safety devices and actuators, comprising at least one input monitored for short circuits and open circuits for connection to said safety devices and actuators, at least one output for connection to said machine or process, one or a plurality of stop relays for maintaining and interrupting, respectively, the connection to said machine or process in response to a momentary state of said safety devices and actuators, and a reset circuit with at least one capacitor and a reset input, the capacitor being arranged to receive and store electrical energy in a first state and to supply this energy in a second state for resetting the safety relay to a normal state of operation.

DESCRIPTION OF THE PRIOR ART

Safety relays of the type described above are used in many industrial applications, for instance for ensuring safe operation of safety devices and actuators, for achieving safe stops for dangerous machines and processes, and for monitoring stop inputs and the internal safety of machines. These safety relays are used today in a variety of different applications, for instance robots, presses, production systems, paper machines, etc. Generally, machines and industrial processes controlled or monitored by a human operator imply a potential risk of personal injury, in case an unforeseen machine fault or incorrect handling takes place. Several different types of safety devices, such as light bars, contact mats, safety gates, hatches, safety strips or emergency stop buttons, are used for obtaining maximum safety. Such safety devices are commonly monitored by a safety relay of the type described above. In summary the purpose of the safety relay is to detect, through its inputs, any changes in the monitored equipment—one example may be a switch, which detects an opened safety gate—and in response thereof cause the stop relays to |de-energize| (i.e., fall), thereby causing an interruption in the supply of power to the apparatus in question.

A variety of different standards and requirements are put on modern safety relays. The present invention is particularly aimed at the field of supervised reset, which means that a fault in a reset button, connection wires or other components comprised in the safety relay must not cause an unintentional reset of the safety relay. The Swedish patent publication SE-C-465 067 discloses a device for production-adapted safety system for a production unit, such as for instance a robot. A safety relay or safety module is provided with double stop relay circuits according to the above. In parallel to the stop relay circuits a reset relay circuit is arranged, said reset relay circuit being provided with a reset means, which must have been closed as well as opened, before the outputs are closed on the double stop relay circuits. The reset relay circuit comprises a capacitor, which is provided with energy in a first state and is arranged to supply energy in a second state to a relay, the latter being arranged to influence the self-energization of the stop relay circuits. Apart from the two main stop relays the device according to SE-C-465 067 comprises two further relays in the reset circuit.

It is most desirable as regards cost as well as performance that safety relays of the type described above may be realized with few and inexpensive components and with minimal space requirements, while all safety requirements are still fulfilled.

A common requirement for safety relays is that a single fault (such as an open circuit or short circuit) in any component must force the safety relay to interrupt the power supply to the machine or process in question. Once the power supply has been interrupted, it must not be resumed, unless the fault has been taken care of. For safety reasons double stop relays are used, which operate independently from each other and which interrupt the power supply when a fault occurs and prevent unauthorized reset according to the above. As regards the reset circuit, all components comprised in the circuit must be actively monitored for malfunction, i.e. an erroneous function of any of the components must not cause the reset circuit to reset the stop relays comprised in the safety relay. Furthermore, both stop relays must have de-energized (i.e. must have interrupted the power supply) before reset is performed. Additionally, both stop relays must energize (i.e., pull) before power supply to the machine or process in question is possible.

Another problem is this regard is that the available voltage is not always sufficient for driving the stop relays, so that they will energize when the safety relay is reset. Such problems may be due to undervoltage or energy losses in long wires.

SUMMARY OF THE INVENTION

The main object of the present invention is to provide a safety relay, the reset circuit of which may be realized with a minimum of costly components (i.e. with a minimum number of relays), where all components comprised in the reset circuit are actively monitored.

Another object of the present invention is to provide an inexpensive and yet secure reset circuit according to the above, which additionally may be used in one-channel safety relays as well as multi-channel safety relays with a constant number of essential components.

Furthermore, some embodiments of the present invention aim at providing a reset circuit, which does not require any relay at all apart from the two main relays (stop relays).

Yet another object of some embodiments is to allow reset for a safety relay, despite a condition of under-voltage or large voltage drops in long wires.

Finally, one embodiment of the present invention aims at providing an automatic reset function for the safety relay.

The objects described above are achieved by a safety relay with features according to the appended patent claims.

BRIEF DESCRIPTION OF THE DRAWINGS

Preferred embodiments of the present invention will now be described in more detail, reference being made to the accompanying drawings, in which.

DISCLOSURE OF PREFERRED EMBODIMENTS

Figure 1:
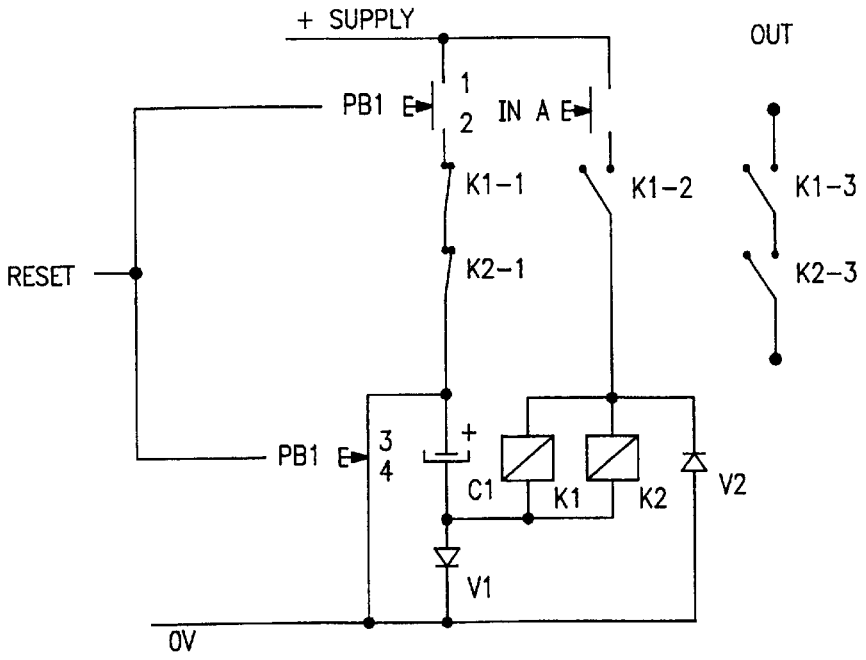
FIG. 1 is a circuit diagram for the reset circuit in a one-channel safety relay according to a basic embodiment of the invention.

The purpose of FIG. 1 is to illustrate the basic reset function in a safety relay according to the invention. The safety relay input In A is assumed to be connected to any interrupting function in the monitored machine/process or its surroundings. For instance, the input In A may be connected to a sensor, which detects that a safety gate has been opened. Two stop relays K1–3 and K2–3 are, for the safety reasons set out above, connected with its contacts in series with the output OUT of the safety relay. These relay contacts K1–3 and K2–3 are closed during normal operation, but will de-energize, as soon as the switch In A is activated in response to for instance the safety gate having been opened during ongoing machine operation. Hence, the safety relay ensures that the machine operation is immediately interrupted so as to avoid a risky situation (such as the operator of the machine coming too close to active machine elements).

Once the situation has returned to normal (the safety gate has been closed, an electrical malfunction has been remedied, etc), a reset means PB1 must first be closed and then opened for resetting the safety relay to its normal operating condition. The reset procedure according to a basic embodiment of the present invention will now be described.

The main principle is that a capacitor C1 is charged when the reset means is actuated. However, charging is only to take place on condition that the monitored stop relays K1–3 and K2–3 have de-energized. If this is the case and if the reset means is actuated (pressed), the current path is closed from the positive voltage supply indicated in the uppermost portion of the drawing via the contacts 1, 2 of the reset means PB1 and the relay contacts K1–1 and K2–1 down to the positive side of the capacitor C1. The negative side of the capacitor C1 is connected to the anode of a diode V1, the cathode of which is connected to the zero conductor (or negative supply conductor) indicated as "0 V" in the lowermost most portion of the drawing. Hence, the capacitor C1 is supplied with electrical energy, as long as the reset means PB1 is activated.

The charging path described above is indicated in FIG. 2 by way of a dashed line provided with arrows. As will be described in more detail below, the diode V1 establishes a virtual zero point between the capacitor C1 and the actual zero conductor. Furthermore, the diode V1 forms a common node for the capacitor C1 and the relays K1 and K2, respectively, which according to the following are activated during the reset procedure.

Once the activation of the reset means ends, i.e. PB1 is released, the electrical charges stored in capacitor C1 are conducted from the positive side of the capacitor through the contacts 3 and 4 of the reset means PB1, the zero conductor and a second diode V2 to the relay coils in K1 and K2 and then to the negative side of the capacitor C1. This closed discharge current loop is illustrated by way of a dashed line provided with arrows in FIG. 3. The diode V1 prevents the discharge procedure from occurring directly from the zero conductor up to the negative side of capacitor C1. Therefore, the charges are conducted from capacitor C1 through the diode V2 and the relay coils K1 and K2 to the negative side of capacitor C1, relays K1 and K2 thereby energizing. Once they have energized, they are able to self-energize through any of their closing contacts (in the drawing: K1–2), on condition that the input In A is closed.

As mentioned before, the components comprised in the reset circuit must be actively supervised. If for instance a short circuit arises in diode V1, the discharge procedure when the reset means PB1 is released will occur directly through PB1, a short distance of the zero conductor and then through the shorted diode V1 directly back to the negative side of capacitor C1, and therefore no current will flow through the relay coils K1 and K2, respectively, and the relay contacts will be prevented from closing. If on the other hand the diode V1 is the subject of an electrical open circuit, the capacitor C1 cannot be charged, when the reset means PB1 is activated, since the current from the negative side of capacitor C1 cannot run through diode V1 nor from the "reverse side" through the relay coils K1 and K2, thanks to the reverse-biassed diode V2.

Figure 2:
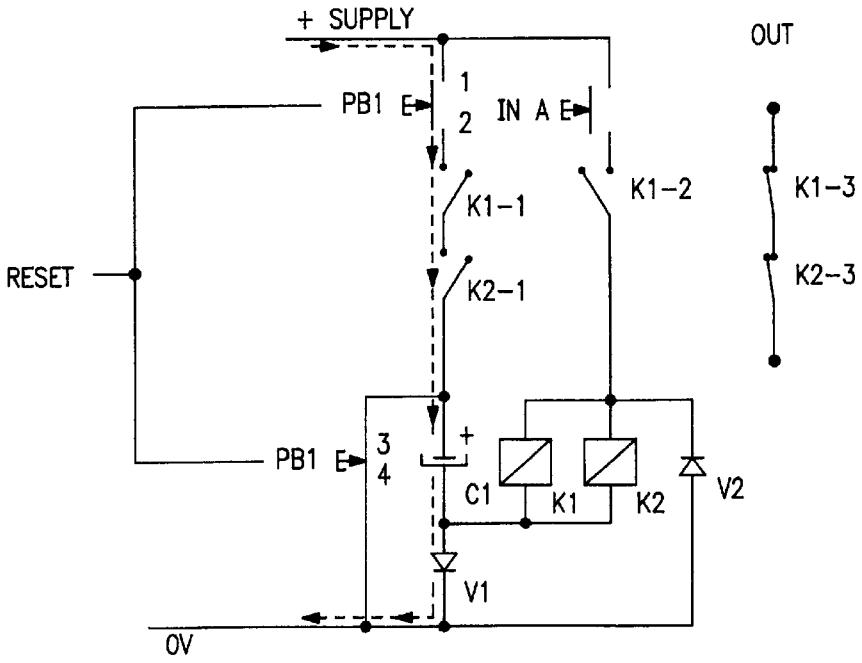
FIG. 2 illustrates a charge procedure in the reset circuit of FIG. 1.
Figure 3:
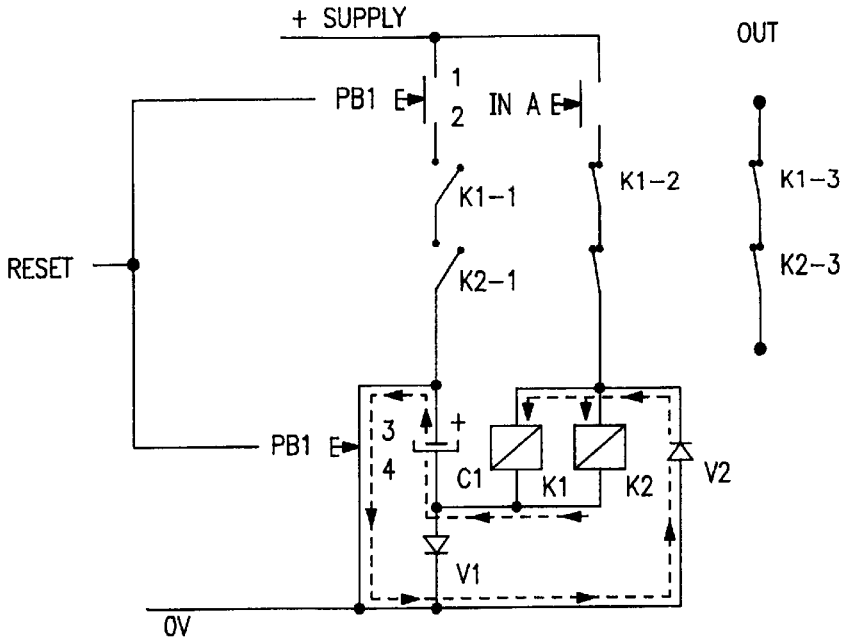
FIG. 3 illustrates a discharge procedure in the reset circuit of FIG. 1.

If it instead is assumed that diode V2 is the subject of a short circuit, it is realized from studies of the circuit diagram according to FIGS. 1–3 that this case cannot cause an unintentional reset of the safety relay. A shorted diode V2 will prevent the relays K1 and K2 from being self-energized through the closed input In A, since the current will be conducted past the relays K1, K2 via the shorted diode V2. Even if V2 would be subjected to an open circuit, the circuitry according to FIGS. 1–3 will prevent unintentional reset, since the discharge path will also be interrupted.

Finally, it is apparent that reset cannot take place unintentionally, should the capacitor Cl itself be subjected to a malfunction, since the charging and discharging functions of the reset circuit will then not be possible.

Hence, according to the invention a supervised reset function is provided in a safety relay at a minimum of components and costs (particularly at a minimum of relays), wherein the risk of malfunctions (unintentional reset) due to a short circuit or an open circuit in any used component has been eliminated by establishing a controlled discharge path to the stop relays through the zero conductor. The basic embodiment described above may be varied and extended in many different ways within the scope of the invention. Particularly advantageous embodiments will now be described with reference to the remaining figures.

Figure 4:
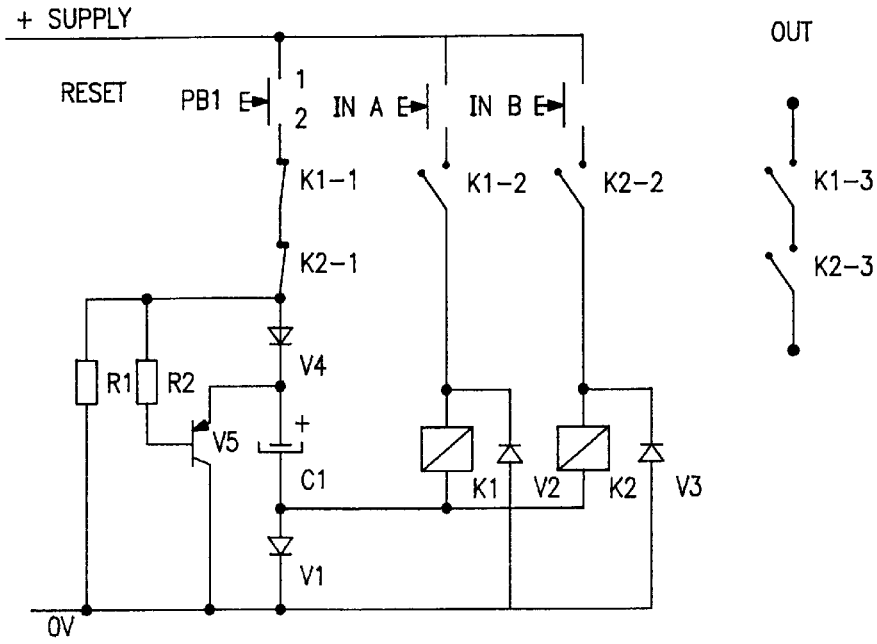
FIG. 4 is a circuit diagram for a semiconductor-based reset circuit in a two-channel safety relay.

In FIG. 4 there is shown a reset circuit for a safety relay with two inputs In A and In B. The same reference numerals as in the preceding figures are used for the same or corresponding components. However, one difference is that the reset circuit of FIG. 4 is fully semiconductor-based, which gives considerable advantages from a manufacturing point of view. As before, the reset procedure starts by activating the reset means PB1. On condition that the relays K1–3 and K2–3 have de-energized, a charging current will be conducted from the positive voltage supply via PB1, K1–1, K2–1 and a diode V4 down to the positive side of the capacitor C1. The negative side of C1 is connected to the second voltage supply conductor (the zero conductor) via the diode V1. Similar to the above a closed current loop will be generated as a consequence, wherein the capacitor C1 is charged.

According to FIG. 4 a bipolar PNP transistor V5 is arranged as a valve for controlling the charging and discharging paths, respectively. The base terminal of the PNP transistor V5 is connected to a resistor R2, which in turn is connected to a resistor R1 as well as a common node between the relay contacts K–1, K2–1 and the anode of the diode V4. The emitter terminal of V5 is connected to a common node between the cathode of the diode V4 and the positive side of the capacitor C1, while the collector terminal is directly connected to the zero conductor. In the charging state the PNP transistor V5 is cut off and no current flows through it.

Once the activation of the reset means PB1 ceases, the PNP transistor V5 switches to its conductive state, wherein the electrical energy stored in capacitor C1 may start flowing as an electrical current from the positive side of C1, through the transistor V5 and down to the zero conductor. Two diodes V2 and V3, respectively, which are biased in the forward direction, conduct the current from the zero conductor to the respective relay coils K1 and K2. The current flows through the relay coils and then back to the negative side of C1. The relays K1 and K2 will energize, and they may subsequently energize themselves through their closing contacts, provided that the inputs In A and In B, respectively, are closed.

The embodiment described above has an advantage in that it allows a realization of the reset circuit, which is completely free from relays (obviously with the exception of the stop relays K1 and K2). The semiconductor-based reset circuit may preferably be realized as a hybride circuit.

Another advantage is that several channels/inputs (here: two) may be served by one single capacitor circuit, i.e. the leftmost portion of the circuit diagram remains the same regardless of whether the safety relay has one or more than one channel.

A person skilled in the art will realize, according to a line of reasoning corresponding to that of FIGS. 1–3, that all components comprised in the reset circuit are monitored for interruption and short circuits, respectively, and that the risk is eliminated for an unintentional reset.

Since the stop relays K1 and K2 require relatively large currents—and consequently also high voltages—in order to energize, it is desired to minimize the voltage drops in the reset circuit according to preceding figures. One possibility is to use low voltage-drop diodes, such as Schottky diodes (voltage drop≈0.1 V). However, sometimes this is not enough in reality, for instance due to long wires. An alternative embodiment of the present invention solves the problem of insufficient voltages by way of a voltage doubling function, which will be described in more detail below with reference to FIGS. 5 and 6.

Figure 5:
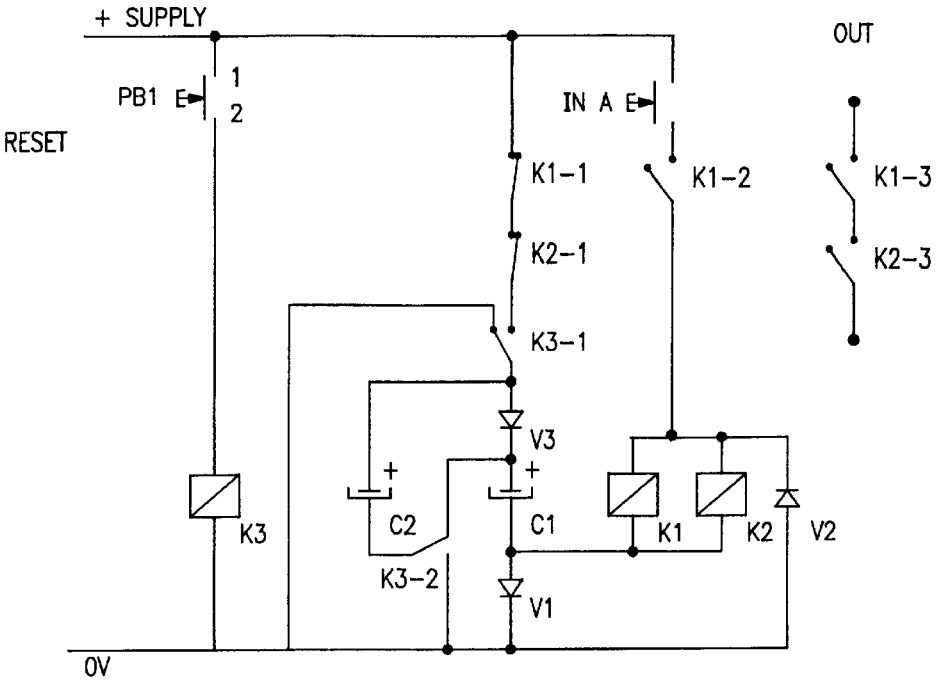
FIG. 5 is a circuit diagram for a relay-based reset circuit with a function for voltage doubling.

FIG. 5 illustrates an embodiment, which is particularly directed at solving the problem described above as regards undervoltages and long wires. The arrangement of FIG. 5 has one channel, but the principle is applicable in all essential details also to multiple channels, such as two channels. Furthermore, FIG. 5 illustrates a relay-based reset circuit with a switching relay K3–1. The stop relays K1–1 and K2–1, the reset means PB1, the input In A and the diodes V1 and V2 correspond to the corresponding components in previous figures and are therefore not described in more detail now. According to the figure the relay coil K3 is connected in series with PB1 between the two supply conductors, and when PB1 is activated, a closed current path is formed from the positive supply, via the relay contacts K1–1, K2–1 and K3–1 (since the relay contact K3–1 assumes its energized position), down through a diode V3, across capacitor C1 and further down through the diode V1 to the zero conductor. Hence, the capacitor C1 is charged in the way described above. Different for this embodiment is that a second capacitor C2 is arranged in the reset circuit. A positive side of C2 is connected to the anode of V3, while the negative side connects to the zero conductor via the closing relay contact K3–2. Therefore, capacitor C2 is charged simultaneously with capacitor C1.

Once the reset means PB1 is released, relay K3 will energize, wherein the relay contact K3–1 assumes its second position and wherein the charging of C1 and C2 ceases. Instead a discharge path is formed from the positive side of C1 via the relay contact K3–1 to the negative side of C2, and then from the positive side thereof via the relay contact K3–2 in its position according to the figure down to the zero conductor. The current continues to flow from this conductor in a normal way through diode V2 to the relay coils K1, K2, which are able to energize. Hence, the two capacitors C1, C2 are discharged in series with each other, which means that the drive voltage available for resetting the safety relay is doubled—provided that the two capacitors are of equal capacitance. Since relays have an inherent hysteresis—they may require for instance 16 V to pull but then only e.g. 5 V for self-energizing—the doubled voltage gives a substantially improved opportunity, at the moment of reset, to overcome any existing problems with undervoltages.

Figure 6:
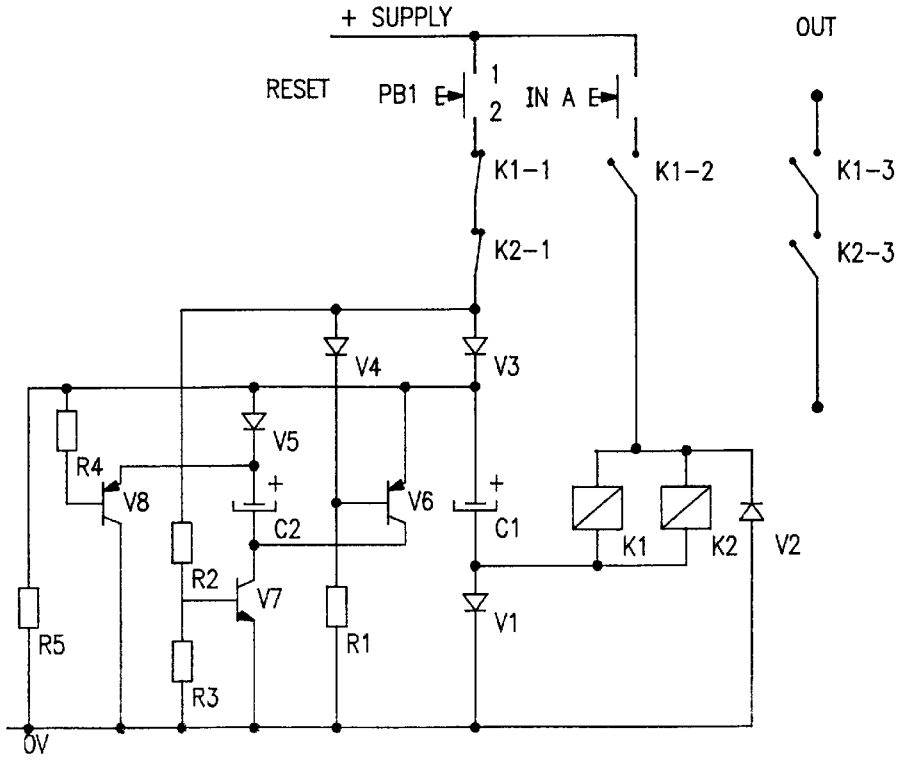
FIG. 6 is a circuit diagram for a semiconductor-based reset circuit in a safety relay with a function for voltage doubling.

FIG. 6 illustrates a semiconductor-based embodiment with a voltage doubling function corresponding to that of FIG. 5. The rightmost portion of the circuit diagram, i.e. the relays K1 and K2, the diodes V1, V2, and V3, and the capacitor C1, corresponds fully to FIG. 5. The difference for FIG. 6 is that a semiconductor-based circuitry is provided as replacement for the relay K3. Two PNP transistors V6, V8 play an active part, together with an NPN transistor V7, during the reset procedure briefly described below.

During the charging thereof the capacitor C1 is charged as described above through diodes V3 and V1. The transistors V6 and V8 are cut off in this moment, while transistor V7 is conductive, wherein a current path parallel to said charging path is formed through the second capacitor C2 via the diode V5 and the transistor V7.

When the activation of the reset means PB1 ends, the transistor V7 is cut off and transistors V6 and VB start to conduct. A discharge path is formed starting from the positive side of capacitor C1, through transistor V6 and further to the negative side of the capacitor C2. From the positive side of the capacitor C2 the discharge current flows from the transistor V8, down to the zero conductor and up through diode V2 to the relay coils K1, K2. In the way described above the relay coils K1, K2 are hence supplied with current, thereby causing them to energize and then to self-energize. Since the transistors V6 and V8 are conductive simultaneously, the capacitors C1 and C2 are connected in series with each other during the discharge, wherein a voltage doubling is achieved and hence a considerably improved opportunity of a successful reset of the safety relay, despite any problems with undervoltages.

Figure 7:
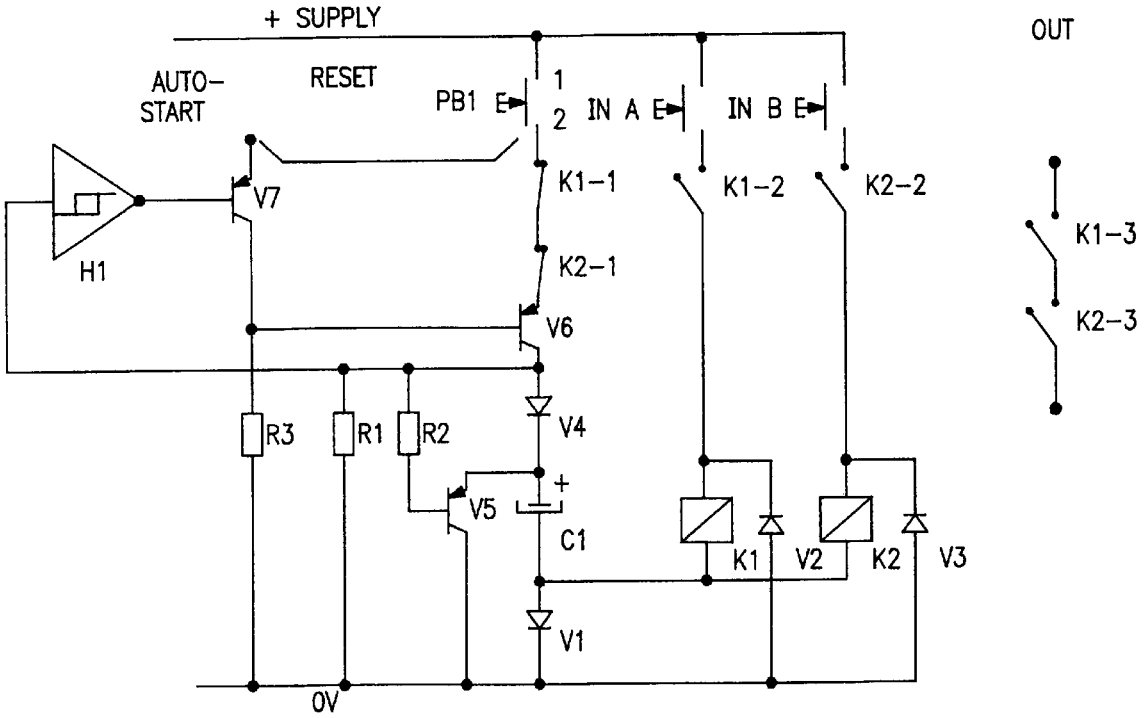
FIG. 7 is a circuit diagram for a reset circuit with an automatic reset function in a safety relay.

Finally, an embodiment with a feature for automatic reset of the safety relay will now be described with reference to FIG. 7. The circuit of FIG. 7 is based on the semiconductor version of a two-channel safety relay of FIG. 4. All components and functions are identical to those of FIG. 4, except for what is mentioned below.

A second PNP transistor V6 is at its emitter terminal connected to the series connection PB1-(K1–1)-(K2–1), while the collector terminal of V6 connects to the anode of diode V4 and to the input of a hysteresis circuit H1, which is symbolically represented by an inverter labelled with a hysteresis sign. The output of the hysteresis circuit H1 is connected to the base input of a third PNP transistor V7, the emitter of which is connected to an autostart input. The collector terminal of V7 is connected to the base terminal of the second PNP transistor V6 and to the zero conductor via a resistor R3.

The embodiment of FIG. 7 is arranged to reset the safety relay, when the reset input PB1 is closed, on condition that the autostart input is connected to the voltage supply, either by direct connection to the positive supply conductor or by indirect connection via a clamp between the autostart input and PB1. When the capacitor C1 is charged in the way described above, the hysteresis circuit H1 will detect the charge level of the capacitor C1. Once the charge exceeds a first limit, the output of the hysteresis circuit H1 will go low, causing the transistor V7 to open and the transistor V6 to be cut off. Consequently the reset circuit will switch to its discharge state, wherein the capacitor C1 is discharged through the transistor V5, the zero conductor, the diodes V2 and V3 and the relay coils K1 and K2, which will energize. When the charge level of capacitor C1 has dropped below a second limit, the hysteresis circuit H1 will switch again, causing the reset circuit to enter a passive idle mode awaiting a forthcoming need for reset due to closed inputs In A, In B, de-energized relay contacts K1–2 and K2–2, etc.

The hysteresis circuit H1, which has been schematically illustrated herein in the form of an inverter with hysteresis properties, may be realized in a suitable way depending on application. To realize a hysteresis circuit with the functionality described above is regarded to be within the field of competence of a skilled person. The important condition to fulfil is that the circuit will actually be given sufficient hysteresis properties, so that oscillation is avoided.

Instead of the hysteresis functionality described above H1 may be arranged to operate according to a time measuring approach. First, H1 will maintain the reset circuit in the charging state according to the above. Once capacitor C1 has reached a certain amount of charging, H1 will be triggered, wherein the reset circuit is maintained in its discharge state during a predetermined time period, which preferably corresponds to the discharge time of capacitor C1. Then the reset circuit will switch to its normal state.

Alternatively, the circuit H1 may first maintain the reset circuit in its charge state during a first predetermined time period, preferably corresponding to the time it takes to charge C1 up to a certain level. Thereinafter the circuit H1 will switch to a second state, wherein the capacitor C1 is discharged during a second predetermined time period.

The diode V2 (and for some embodiments also its parallel diode V3), which is used in all embodiments, may alternatively be realized as a thyristor. Using a thyristor has an advantage in that an external switch, such as an opto-switch, may be connected to the control input of the thyristor, wherein an additional dimension of safety is obtained. If this external switch does not supply an expected control signal to the thyristor (because the external switch has detected an abnormal condition, such as an opened safety gate, etc), the thyristor will not operate normally, wherein unintentional reset is prevented in correspondence with the reasoning for the embodiment of FIGS. 1–3. Furthermore, the thyristor and the separate opto-switch may be replaced by an opto-thyristor.

The invention, which has been described above by way of a number of preferred and alternative embodiments, may be realized in many different ways within the scope of protection of the invention, as defined by the appended patent claims. It is particularly noticed that the zero conductor referred to above is equivalent to a conductor for negative voltage supply. It is also noticed that all circuit diagrams may be "mirror-inverted", so that charging takes place from the negative voltage supply, while the discharge paths run through the positive supply conductor. In such cases the PNP transistors shown in the drawings will be replaced by NPN transistors and vice versa.

Additionally, it is regarded to be within the field of competence of a skilled person to replace the standard components used in the embodiments with other components. Hence, the bipolar transistors may be replaced by for instance field effect transistors, while the diodes may be replaced by transistors connected as diodes, etc.

Finally, it is noticed that the stop relays K1, K2 described in the embodiments above may alternatively be realized as a single relay with only one relay coil but two independent contact halves, wherein each contact half comprises at least one closing and one opening relay contact, which are connected in a controlled arrangement. Such a relay may, at least in simple applications, therefore replace the function of the double stop relays K1, K2 disclosed in the drawings with preserved safety.

What is claimed is:

1. A safety relay for supervising and ensuring safe operation of a machine or an industrial process and corresponding safety devices and actuators, comprising:

at least one input supervised for short circuits and open circuits for connection to said safety devices and actuators;

at least one output for connection to said machine or process;

one or more than one stop relay for maintaining and interrupting, respectively, the connection to said machine or process depending on a momentary state of said safety devices and actuators;

a reset circuit with at least one capacitor and a reset input, wherein the capacitor is arranged to receive and store electrical energy in a first state and to discharge its electrical energy in a second state for resetting the safety relay to a normal state of operation;

first means connected to the capacitor, said first means being arranged to establish, in said first state, a closed current path between a first and a second supply conductor for charging the capacitor and to isolate, in said second state, the capacitor from the second supply conductor; and second means connected in parallel to the capacitor, said second means being arranged to conduct current, in said second state, from the capacitor via the second supply conductor to the relay coils of the stop relays for resetting the safety relay.

2. A safety relay according to claim 1, further comprising third means connected between said second supply conductor and the relay coils of the stop relays, said third means being arranged to prevent electrical current from flowing from the relay coils to the second supply conductor.

3. A safety relay according to claim 1, wherein the relay coils of the stop relays are connected to a common node between the capacitor and the first means.

4. A safety relay according to claim 1, wherein said first means is a diode.

5. A safety relay according to claim 1, wherein said second means is a transistor.

6. A safety relay according to claim 2, wherein the third means is a diode.

7. A safety relay according to claim 2, wherein the third means is a thyristor.

8. A safety relay according to claim 1, further comprising a second capacitor, which is arranged to be charged together with the first capacitor in said first state and to be discharged in series with the same in said second state so as to double the electrical voltage available at the reset.

9. A safety relay according to claim 1, further comprising a hysteresis circuit, which is arranged to detect the level of charge of the capacitor and in response thereof cause a transition of state from said first state to said second state, when the level of charge exceeds a first limit, and to cause a transition of state from said second state to an idle state, when the level of charge is below a second limit.

10. A safety relay according to claim 1, further comprising a time measuring circuit, which is arranged to detect when the level of charge of the capacitor exceeds a first limit, in response thereof cause a transition from said first state to said second state, and after a predetermined time period cause a transition of state from said second state to an idle state.

11. A safety relay according to claim 1, further comprising a time measuring circuit, which is arranged to maintain the reset circuit in its first state during a first predetermined time period, when an input signal on the reset input fulfils a predetermined condition, and to maintain the reset circuit in its second state during a second predetermined time period.

12. A method of resetting a safety relay, the safety relay comprising double stop relays and at least one capacitor, wherein the capacitor is arranged to receive and store electrical energy in a first state, after a fault condition has occurred and a reset signal has been received, and to discharge its electrical energy in a second state for resetting the safety relay to a normal state of operation, the method comprising the steps of:

establishing, in said first state, an electrical connection between a first side of the capacitor and a first supply conductor and between a second side of the capacitor and a second supply conductor, respectively, for charging the capacitor; and establishing, in said second stage, an electrical connection between the first side of the capacitor and the second supply conductor, while isolating the second side of the capacitor from the second supply conductor, for supplying the electrical energy stored in the capacitor via the second supply conductor to the relay coils of the stop relays.

* * * * *